United States Patent [19]

Ruhle

[11] Patent Number: 4,679,636

[45] Date of Patent: Jul. 14, 1987

[54] METHOD AND APPARATUS FOR CORING ROCK

[76] Inventor: James L. Ruhle, 2535 E. Balfour Ave., Fullerton, Calif. 92634

[21] Appl. No.: 919,650

[22] Filed: Oct. 16, 1986

[51] Int. Cl.[4] ..... E21B 10/02; E21B 25/04

[52] U.S. Cl. ..... 175/58; 175/104; 175/248; 175/249; 175/403

[58] Field of Search ..... 175/20, 58, 104, 239, 175/244, 248, 249, 403, 404

[56] References Cited

U.S. PATENT DOCUMENTS

| | | | |
|---|---|---|---|
| 2,140,417 | 12/1938 | Conklin | 175/248 |
| 4,002,213 | 1/1977 | Sweeney | 175/58 |
| 4,588,036 | 5/1986 | Desrochers et al. | 175/244 |

FOREIGN PATENT DOCUMENTS

| | | | |
|---|---|---|---|
| 2142363 | 1/1985 | United Kingdom | 175/403 |

OTHER PUBLICATIONS

H. L. Johnson, Improved Sampler and Sampling Technique for Cohesionless Materials, Jun. 1940, Civil Engineering, pp. 346–348.

*Primary Examiner*—James A. Leppink
*Assistant Examiner*—Terry Lee Melius

[57] ABSTRACT

A low-cost retrievable light-weight high-speed thin-kerf reversible electrically-driven core-sampling method and apparatus that is independent of the weight of any drill pipe, drill collars, or any other heavy cylindrical or tubular conduit associated with the coring operation. The flow direction of electric current to the direct-current electric motor of the core-sampling assembly is automatically reversed at frequent intervals so as to cause corresponding reversals in the direction of rotation of its core bit, resulting in the cancellation of any lateral forces on the core bit produced by reactive torque created during the coring operation, since such forces are alternately applied in opposite directions, thus, eliminating any corehole deviation that, otherwise, might occur from the lateral force created by the reactive torque of a down-hole motor that is rotated in just one direction. Geologically-induced lateral forces on the core bit are also minimized because of the light weight and high speed of the reversible electrically-driven core-sampling assembly, which quickly decreases its angle with the vertical, should its trajectory deviate from the vertical.

4 Claims, 2 Drawing Figures

METHOD AND APPARATUS FOR CORING ROCK

BACKGROUND OF THE INVENTION

Small-diameter light-weight coring systems, particularly, the wire-line conveyed core-sampling apparatus employed by the mining industry, have a tendency while progressing downward through the rock to deviate considerably because of the inadvertent application of excessive amounts of weight upon the light-duty coring equipment. Consequently, deviation of the corehole trajectory from the vertical often becomes excessive, thus, necessitating costly remedial measures directed at reducing the corehole deviation to within acceptable limits.

Furthermore, if the down-hole coring apparatus is driven to the right, or clockwise, by a down-hole motor, as viewed from above, the reactive torque transmitted from the face of the diamond-impregnated core bit (or any other high-friction drag-type cutting head) to the down-hole motor, results in a corehole deviation pattern that spirals to the left, or counterclockwise, as portrayed by the trace of the corehole trajectory on a horizontal plane. In the parlance of the trade, this down-hole lateral force is referred to as "left-hand torque", and the down-hole motor is said to "crank to the left", whereas the course of the corehole is said to "walk to the left". In down-hole coring operations, particularly, those that must be performed with minimal corehole deviation, a coring system that prevents the inadvertent application of excessive amounts of weight upon the light-duty coring apparatus, a coring system that is capable of eliminating corehole deviation induced by reactive torque, and a coring system that is able to minimize geologically-induced corehole deviation, would be, particularly, desireable.

SUMMARY OF INVENTION

It is among the objects of the invention to provide a new and improved coring apparatus and process that applies precisely controlled axial thrust to the light-duty coring apparatus, and, thus, prevents the application of excessive weight from associated heavy cylindrical components to the light-duty coring apparatus that, otherwise, might cause excessive corehole deviation.

Another object of the invention is to provide a new and improved coring apparatus and process in which the core-sampling assembly is driven by a reversible direct-current electric motor so as to eliminate corehole deviation induced by reactive torque.

Still another object of the invention is to provide a new and improved coring apparatus and process in which the relatively light weight and high speed of the reversible electrically-driven core-sampling assembly allows the apparatus to quickly decrease it angle with the vertical if and when the course of the corehole deviates from the vertical as a result of geological conditions encountered by the descending core bit.

With these and other objects in view, the invention consists in the arrangement and combination of the various process apparatus of the invention, whereby the objects contemplated are attained, as hereinafter set forth, in the appended claims and accompanying drawings.

Figure 1:
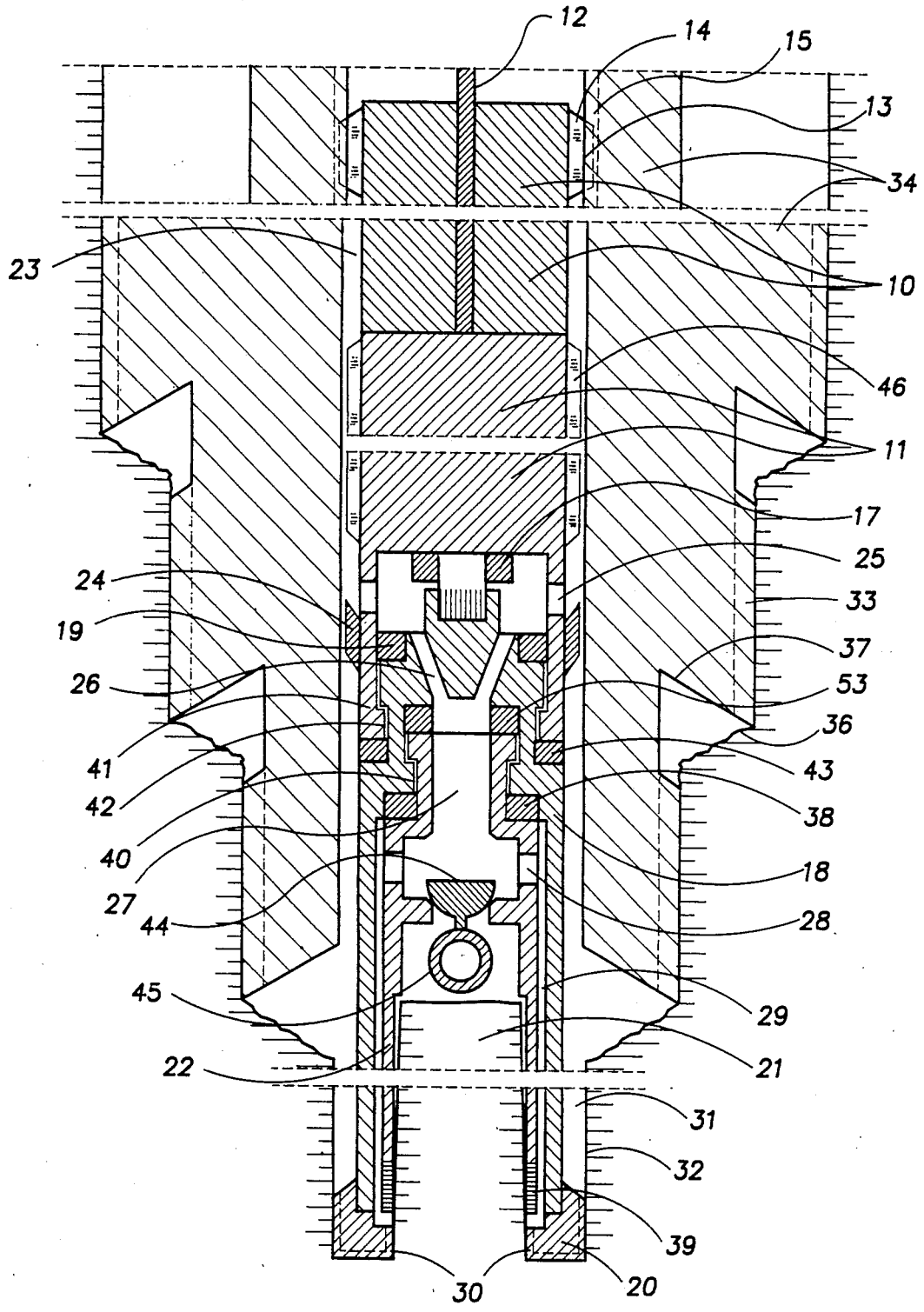
FIG. 1 is a schematic longitudinal sectional view of one variation of the coring apparatus, which employs a wire-line conveyance system.
Figure 2:
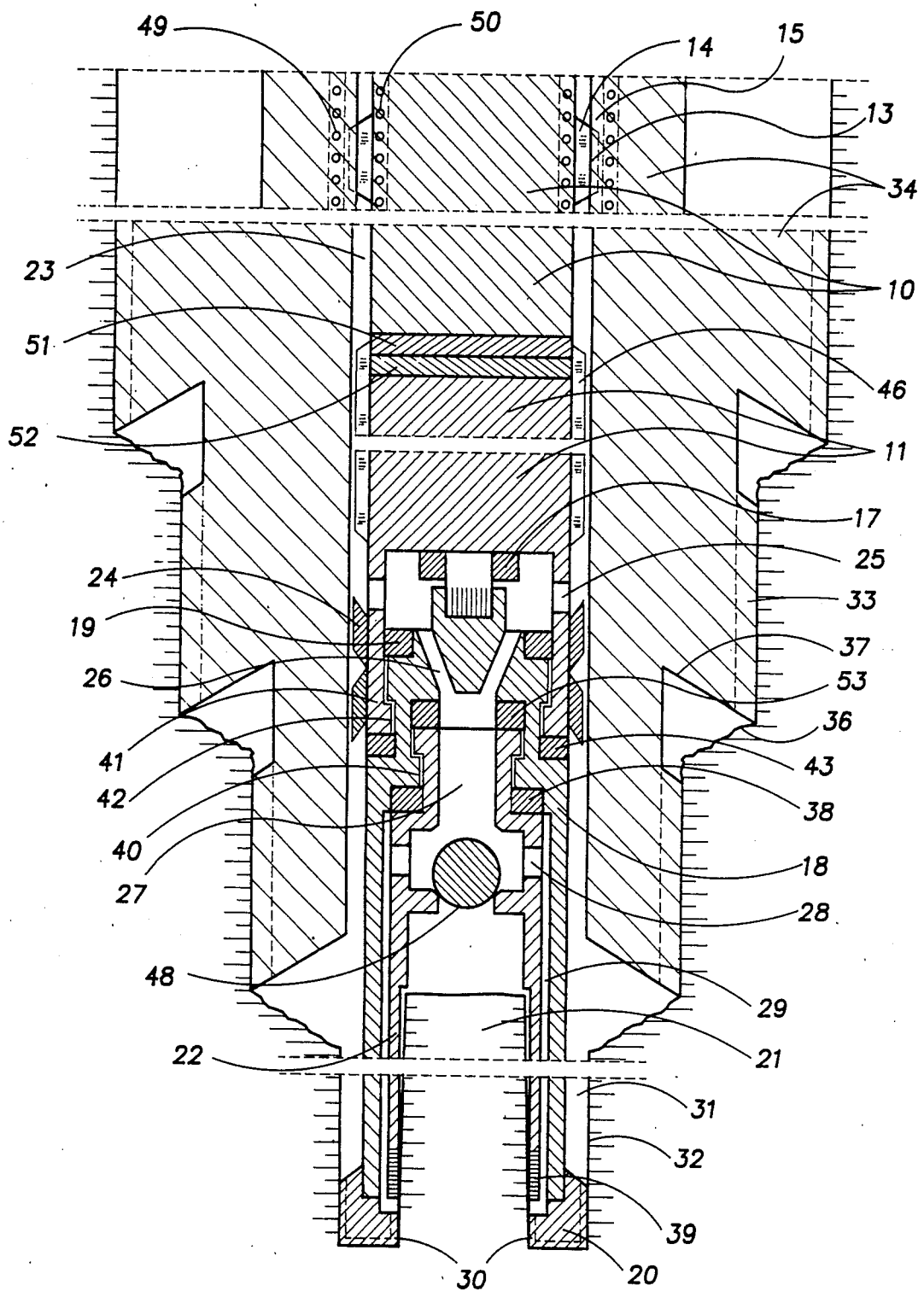
FIG. 2 is a schematic longitudinal sectional view of another variation of the coring apparatus, which employs a hydraulic conveyance system.

Drawing on a typical condition as an example in describing the apparatus and method, it can be assumed that the reversible electrically-driven core-sampling apparatus depicted in both FIG. 1 and FIG. 2 is deployed at the bottom of the hole through the central and axial bore of either a rotational or linear-motion hole-enlarging device, known in the trade as a "hole opener", and employs a high-speed thin-kerf diamond impregnated core bit measuring $2\frac{1}{2}$ inches in outside diameter and 2 inches in inside diameter so as to cut a 2 inch-diameter core, whereas the directcurrent electric motor and the weight unit, or sinker bar, measured $2\frac{1}{4}$ inches in diameter, and the central and axial bore through the hole opener measures $2\frac{3}{4}$ inches in diameter, with said hole opener successively enlarging the corehole to $8\frac{1}{2}$ inches in diameter.

The coring operation takes place ahead of the hole-opening operation until the core barrel is either filled to capacity, or until the core barrel is obstructed, or jammed by the core, after which the reversible electrically-driven core-sampling assembly is retrieved at the surface, and the corehole is enlarged by the hole opener. Circulation of the drilling fluid is in the normal manner during coring operations, with the drilling fluid descending through cylindrical conduit to the reversible electrically-driven core-sampling assembly, and returning to the surface with its load of fine-grained core cuttings through the borehole annulus, whereas during hole-opening operations the drilling fluid is circulated in the reverse direction, down through the borehole annulus, returning to the surface with its load of coarse-grained hole-opener cuttings up through the cylindrical conduit.

The electrically-driven core-sampling assembly depicted in FIG. 1 is wire-line conveyed through cylindrical conduit between the ground surface and the bottom of the corehole, with the electric power also transmitted through the same wire-line conveyance system as direct durrent. The electrically-driven core-sampling assembly depicted in FIG. 2 is hydraulically-conveyed through cylindrical conduit between the ground surface and the bottom of the corehole, whereas the electric power is transmitted to the bottom of the corehole by means of an electrical circuit incorporated into the wall of the cylindrical conduit, with power transmission to the bottom of the corehole by alternating electric current that is linked to the reversible electrically-driven core-sampling assembly by means of an induction-coil system, and is rectified to direct current at the point of use. The flow direction of direct current is automatically reversed at frequent intervals for both the wire-line conveyed and hydraulically-conveyed core-sampling assemblies so as to alternately drive the core barrel and its attached core bit in both clockwise and counterclockwise directions. A weighted unit, or sinker bar, which constitutes the bulk of the mass of the reversible electrically-driven core-sampling assembly, is the primary source of weight on the core bit, with no weight applied to the core bit at any time from the hole opener, or from any other cylindrical or tubular component between the hole opener and the ground surface.

In an embodiment of the invention chosen for the purposes of illustration, there is shown in FIG. 1 and FIG. 2 a reversible electrically-driven core-sampling assembly composed of a weighted unit, or sinker bar, 10, rigidly affixed to a reversible highspeed direct-current electric motor, 11, which is supplied by electric power in FIG. 1 through the wire-line conveyance system, 12, with the weighted unit, or sinker bar, 10, guided through the central and axial hole-opener bore, 13, by means of guide fins, two of which are designated, 14, rigidly affixed to the weighted unit or sinker bar, 10, said guide fins engaging longitudinal guide slots, two of which are designated, 15, in the central and axial hole-opener bore, 13, thus, preventing the rotation of either the weighted unit, or sinker bar, 10, and the attached direct current electric motor, 11, relative to the central and axial hole-opener bore, 13. The splined rotational output shaft, 16, of the direct-current electric motor, 11, passes through the pressure-actuated seal, 17, and rotates the rotating outer cylindrical core barrel, 18, which is crowned near its top by a pressure-actuated seal, 19. The rotating outer cylindrical core barrel, 18, rotates the thinkerf core bit, 20, which cuts the core of rock, 21, which, in turn, is enveloped by the nonrotating inner cylindrical core barrel, 22, which is crowned at its top by the pressure-actuated seal, 53.

During coring operations the drilling fluid is pumped down through cylindrical conduit from the surface through the central and axial hole-opener bore, 13, through the annular space, 23, between the reversible electricall-driven core-sampling sampling assembly and the central and axial hole-opener bore, 13 to a pressure-actuated up-facing annular cup seal, 24, where the down-flowing drilling fluid is diverted through a plurality of side ports, two of which are designated 25, into the interior of the reversible electrically-driven core-sampling assembly. The drilling fluid then flows down through a plurality of inclined fluid passageways, two of which, are designated, 26, near the top of the rotating outer cylindrical core barrel, 18, through the central and axial fluid passageway, 27, at the top of the inner nonrotating cylindrical core barrel, 22, through a plurality of side ports, two of which are designated, 28, near the top of the nonrotating inner cylindrical core barrel, 22, through the annular space, 29, between the rotating outer cylindrical core barrel, 18, and the nonrotating inner cylindrical core barrel, 22, and through water courses, two of which are designated, 30, in the thin-kerf core bit, 20, where fine-grained core cuttings are flushed from the face of the thin-kerf core bit, 20, and carried by the drilling fluid through the annulus, 31, between the rotating outer cylindrical core barrel, 18, and the corehole wall 32. The drilling fluid, with its load of fine-grained core cuttings then flows upward toward the surface through annular spaces, one of which is designated, 33, between the hole opener, 34, and the borehole wall, part of which is designated, 35.

The reactive torque generated at the bottom of the corehole is transmitted up through the rotating outer cylindrical core barrel, 18, through the direct-current electric motor, 11, to the weighted unit, or sinker bar, 10, where it is transferred through the longitudinal guide fins and longitudinal guide slots to the hole opener, 34, which rests directly upon excavated shoulders of rock, one of which is designated, 36, said hole opener, 34, held fast by the friction of its cutting blades, one of which is designated, 37, upon the excavated shoulders of rock, whereas the nonrotating inner cylindrical core barrel, 22, rotates against the swivel bearing, 38, situated near the top of said nonrotating inner cylindrical core barrel, 22. At the completion of the coring operation when the core of rock, 21, is broken, or uprooted from the bottom of the corehole by means of the annular wedge system, or core catcher, 39, the core-breaking load is transferred to the inward-facing shoulder, 40, of the rotating outer cylindrical core barrel, 18, and then to the inward-facing shoulder, 41, of the electric motor case extension, 42, whereas the axial load created by the weighted unit, or sinker bar, 10, is transferred through the nonrotating electric-motor case extension, 42, to the rotating outer cylindrical core barrel, 18, by means of the thrust bearing, 43.

After the coring operation is completed the reversible electrically-driven core-sampling assembly depicted in FIG. 1 is hoisted to the surface by means of the wire-line conveyance system, 12, whereas after the hole-opening operation is completed, the reversible electrically-driven core-sampling assembly depicted in FIG. 1 is returned to the bottom of the hole by means of the same wire-line conveyance system. When hoisting the reversible electrically-driven core-sampling assembly depicted in FIG. 1 to the surface, by-pass of the drilling fluid through the reversible electrically-driven core-sampling assembly takes place in the same manner as does the down-flowing passage of drilling fluid during coring operations, whereas when returning the reversible electrically-driven core-sampling assembly to the bottom of the hole, by-pass of the drilling fluid takes place around the relaxed pressure-actuated up-facing annular cup seal, 24, and through the one-way check valve, 44, with the travel distance of said one-way check valve, 44, controlled by the ring-stop, 45, situated at the bottom extremity of its valve stem, said by-pass of drilling fluid also taking place through the side ports, two of which are designated, 28, near the top of the nonrotating inner cylindrical core barrel, 22, whereupon all the by-passing drilling fluid within the core-sampling assembly flows up through the central and axial fluid passageway, 27, through the inclined fluid passageways, two of which are designated, 26, and through the side ports, two of which are designated, 25. The one-way check valve, 44, also functions as a vent valve during coring operations, if and when drilling-fluid compression should occur above the ascending core of rock, 21, whereas a plurality of centralizing heat-sink fins, two of which are designated, 46, centralize the reversible electrically-driven core-sampling assembly within the central and axial hole-opener bore, 13, said plurality of centralizing heat-sink fins situated in an offset manner with respect to the longitudinal guide slots, two of which are designated, 15, in the central and axial hole-opener bore, 13, with said plurality of centralizing heat-sink fins also providing a means to dissipate heat from the direct-current electric motor, or from any associated power-conditioning equipment, to the down-flowing drilling fluid.

During hole-opening operations, in the absence of the reversible electrically-driven core-sampling assembly, drilling fluid is circulated down through annular spaces, one of which is designated, 33, between the hole opener, 34, and the borehole wall, part of which is designated, 35, and the coarse-grained hole-opener cuttings are flushed into the empty central and axial hole-opener bore, 13, where the drilling fluid and its load of coarse-grained hole-opener cuttings flow upward through the central, or axial bore of the hole opener, 34, on their way to the surface.

The hydraulically-conveyed reversible electrically-driven core-sampling assembly depicted in FIG. 2 differs from the wire-line conveyed reversible electrically-driven core-sampling assembly depicted in FIG. 1, as follows:

1. A down-facing pressure-actuated annular cup seal, herein designated, 47, is affixed to the motor-case extension, 42 just below the up-facing pressure-actuated annular cup seal, 24, so as to provide a means to pump the hydraulically-conveyed core-sampling assembly from the bottom of the corehole to the surface.
2. A ball valve, herein designated 48, is substituted for the check valve, 44, so as to, not only, provide, by sealing action on its lower sealing surface, the same function as that provided by said check valve, 44, but, also, by sealing action on its upper sealing surface, to assist the down-facing pressure-actuated annular cup seal, 47, in slowing the descent of the hydraulically-conveyed reversible electrically-driven core-sampling assembly as it is propelled by gravity through cylindrical conduit from the surface to the bottom of the hole, with said ball valve, 48, sealing upon its upper sealing surface, and said down-facing pressure-actuated annular cup seal, 47, pressure-actuating when the downward velocity of the hydraulically-conveyed reversible electrically-driven core-sampling assembly exceeds a certain critical level. In like manner, said ball valve, 48, seals upon its upper sealing surface, and said down-facing pressure-actuated annular cup seal, 47, pressure-actuates when the hydraulically-conveyed reversible eletrically-driven core-sampling assembly is pumped to the surface from the bottom of the corehole.

3. An in-wall alternating current electrical circuit in the cylindrical conduit, and an induction-coil system at the bottom of the hole is substituted for the wire-line conveyance system, with copper wire incorporated into the wall of fiber-reinforced nonmetallic composite pipe being an example of the in-wall alternating-current electrical circuit and cylindrical conduit system, and the coupling technology described in my U.S. Pat. No. 4,548,428 "Anti Back-Out Steel Coupling System for Nonmetallic Composite Pipe" being an example of the manner in which in-wall electrical circuits in individual sections of fiber-reinforced nonmetallic composite pipe might be connected together as one continuous in-wall electrical circuit. The induction-coil system consists of an insulated outer primary coil subsystem, herein designated, 49, that forms an interior lining of a slightly-enlarged central and axial bore, 13, within the upper part of the hole opener, 34, so as to accommodate said insulated outer primary coil subsystem, 49; and an inner insulated secondary-coil subsystem, herein designated, 50, that forms an exterior cover on the weighted unit, or sinker bar, 10, slightly reduced in diameter so as to accommodate said inner insulated secondary-coil subsystem, 50, said insulated outer primary coil subsystem, 49, connecting directly to the electrical power supply that is transmitted to the induction-coil system by means of the in-wall alternating-current electrical circuit in the cylindrical conduit, and said inner insulated secondary coil subsystem, 50, connected to the direct current electric motor, 11, by way of a rectifying diode system, herein designated, 51, that converts the alternating current to direct current, and an automatic switching device, herein designated, 52, that is equipped with its own battery pack, and automatically reverses at frequent intervals the flow direction of the electric current to and from the direct-current electric motor. That part of the weighted unit, or sinker bar, 10, enveloped by the insulated inner secondary coil subsystem, 50, is composed of a suitable ferromagnetic metal possessing a high degree of magnetic permeability so as to function as the central core of the induction-coil system, whereas the upper part of the hole opener, 34, is also composed of a suitable ferromagnetic metal, possessing a high degree of magnetic permeability so as to confine the outbound electromagnetic lines of force to within the cylindrical wall of the hole opener, 34, thus reducing electromagnetic flux leakage around the exterior of the induction coil system, and, thereby, allowing a greater concentration of electromagnetic flux within the weight unit, or sinker bar, 10, that constitutes the central core of the induction coil system, so that its oscilating electromagnetic field may readily induce alternating electric current into the insulated inner secondary coil subsystem, 50. Such an induction coil system makes it possible to transmit electric power to the hydraulically-conveyed core-sampling assembly without any sliding electrical contacts that otherwise might short-circuit through the drilling fluid in which the electrically-driven core-sampling assembly and the surrounding hole opener are completely immersed.

The weight or mass of the weighted unit, or sinker bar, can be precisely adjusted to satisfy specific weight requirements on the core bit by simply adding standard lengths of sinker bar to, or subtracting standard lengths of sinker bar from the top of the electrically-driven core-sampling assembly before it is returned to the bottom of the hole. Such a weight-control system would make it possible by the application of relatively modest amounts of weight to achieve a relatively high level of axial thrust per square inch of core-bit cutting face because of the relatively small diameter and thin kerf of the core bit, and the hydraulic-thrust contribution made by the down-flowing and pressurized drilling fluid upon the reversible electrically-driven core-sampling assembly, thus, allowing the application of the precisely required level of axial thrust without the danger of overloading the core bit and causing excessive deviation from the vertical.

Inasmuch as a down-hole direct current electric motor can rotate, even with gear reduction, at much higher rotational speeds than any state-of-the-art down-hole motor that is hydraulically-actuated by the drilling fluid, such high rotational speeds would create, with constant weight on the core bit, much higher levels of reactive torque, which, in turn, would create higher levels of lateral thrust on the core bit, and more severe deviation of the corehole trajectory from the vertical, thus, necessitating reversals in the direction of rotation so as to cause reversals in the reactive torque, reversals in the direction of lateral thrust on the core bit, and consequent cancellation of the lateral thrust. Such reversals in the rotation direction of a down-hole electrically-driven core-sampling assembly are possible only when it is driven by a down-hole reversible electric motor. There are no reversible down-hole hydraulically-actuated positive displacement motors, and there are no reversible down-hole turbine motors.

Inasmuch as the reactive-torque-induced lateral thrust on the core bit can be, essentially, cancelled, this would allow the reversible electrically-driven core-sampling assembly to be driven at the high rates of speed made possible by the high-speed down-hole direct-current electric motor, without excessive corehole deviation, and would allow the high rotational speed of the core bit to overshaddow its axial thrust, if so desired.

Consequently, when coring in complex geological formations with variable and inclined layered directional properties, such as gneissic banding, or variable structural properties, such as inclined faults, which may subject the core bit to a wide range in both the amount and direction of lateral thrust, if the rotational speed of the reversible electrically-driven core-sampling assembly is allowed to overshaddow its axial thrust, and dominate the excavation process by a relative increase in the milling action of its high-speed core bit against the low side of the corehole, this should cause a rapid decrease in its drift angle, if and when the course of the corehole should deviate from the vertical as a result of geological conditions encountered by the advancing core bit. The rotational speed of the down-hole electrically driven core sampler can be changed at will by simply increasing or decreasing the applied voltage by suitable transformer means prior to rectification to direct current. Frequent reversals in the flow direction of the direct current to and from the reversible electrically-driven core sampler depicted in FIG. 1 can be achieved by an automatic switching device connected to the power plant's rectifier at the surface. If alternating instead of direct current is transmitted through the wire-line conveyance system depicted in FIG. 1, a down-hole transformer, rectifier, and automatic switching assembly could be incorporated into the wire-line conveyance system to transform voltage, rectify the current, and automatically reverse the flow direction of the resulting direct current at the terminals of the down-hole electric motor. In applications employing thermally-insulated cylindrical conduit, such as fiber-reinforced nonmetallic composite pipe, and a high-quality drilling-fluid cooling system, the downhole electrically-driven core-sampling apparatus and method should be, particularly, suitable since the drilling fluid should, very effectively, cool the down-hole electric motor, or any power-conditioning equipment, and should, very effectively, cool the diamond-impregnated core bit, and, thus, allow the high rotational speeds made possible by this apparatus and method.

All threaded connections on the down-hole electrically-driven core-sampling assembly might be equipped with the set-screw locking system described in my U.S. Pat. No. 4,548,428 "Anti Back-Out Steel Coupling System for Nonmetallic Composite Pipe" so as to guarantee that such threaded connections do not unthread during the alternate clockwise and counterclockwise rotation of the reversible electrically-driven core-sampling assembly.

Having described examples of employing the present invention, I claim:

1. The invention of a wire-line conveyed assembly of down-hole reversible electrically-driven high-speed thin-kerf coresampling apparatus comprising:

a suitable wire-line conveyance system with connecting means suitable for the support and conveyance of said coresampling assembly through suitable cylindrical conduit to and from the bottom of a hole excavated in rock, and with electrical-connecting means suitable for the transmission of electric power to said core-sampling assembly, a suitable weighted unit, or sinker bar, through which passes said suitable wire-line conveyance system, and to which is rigidly affixed a plurality of guide fins arranged in a longitudinal manner on the exterior surface of said suitable weighted unit, or sinker bar, a suitable reversible direct-current electric motor rigidly affixed to the bottom of said suitable weighted unit, or sinker bar, to which is rigidly affixed a plurality of centralizing heat-sink fins, arranged in a longitudinal manner on the exterior surface of said suitable direct-current electric motor, with suitable electrical-connecting means between said suitable wire-line conveyance system and said suitable direct-current electric motor, and with a motor-case extension and a suitable splined rotational output shaft extending downward from the bottom of said suitable direct-current electric motor, said suitable splined rotational output shaft enveloped at the bottom of said suitable direct-current electric motor by suitable pressure-actuated sealing means so as to exclude outside fluid entry into said suitable direct-current electric motor, a suitable pressure-actuated annular cup seal enveloping said motor-case extension with its sealing lip facing up, and a plurality of side ports through said motorcase extension, said side ports situated above said suitable up-facing pressure-actuated annular cup seal, and a circumferential inward-facing shoulder rigidly affixed to the bottom of said motor-case extension, below which is situated a suitable bearing support, or circumferential thrust bearing, a suitable rotating outer cylindrical core barrel with suitable splined connecting means to said suitable splined rotational output shaft, containing a circumferential out-facing shoulder around its topmost perimeter, above which is situated suitable pressure-actuated sealing means, said suitable rotating outer cylindrical core barrel also containing a plurality of inclined fluid passageways at its top, below which is situated, at the lowermost extremity of said suitable cylindrical core barrel, a suitable core bit containing suitable water courses, a suitable nonrotating inner cylindrical core barrel containing at its topmost extremity suitable pressure-actuated sealing means, below which is situated a central and axial fluid passageway, said suitable nonrotating inner cylindrical core barrel also containing near its top a circumferential out-facing shoulder upon which is situated a suitable swivel bearing, and below which is situated a plurality of side ports and a suitable oneway check valve that allows fluid passage in an upward direction only, whereas near the lower extremity of said suitable nonrotating inner cylindrical core barrel is situated circumferentially near its bottom interior a suitable core-restraining device, or core catcher, a suitable hole-enlarging means, or hole opener, operating in either the linear-motion or rotational excavation mode, with said suitable hole enlarging means, or hole opener, containing a central and axial bore of sufficient diameter to allow the passage of said reversible electrically-driven core-sampling assembly, with said central and axial bore containing in its wall a plurality of longitudinally-arranged guide slots.

2. The invention of a wire-line conveyed down-hole reversible electrically-driven high-speed thin-kerf core-sampling method comprising the following procedure:

conveyance of the reversible electrically-driven core-sampling assembly described in claim 1 by a suitable wire-line conveyance system through suitable cylindrical conduit from the ground surface to the bottom of a hole excavated in rock, providing a source of alternating-current electric power, subsequently rectified to direct-current electric power, and alternately changing at frequent intervals the flow direction of the direct current to and from the suitable direct-current electric motor that drives said reversible electrically-driven core-sampling assembly, said electric power transmitted by means of said suitable wire-line conveyance system, and said frequent changes in the flow direction of direct-current accomplished by suitable automatic switching means, said frequent changes in the flow direction of direct current, correspondingly, causing said reversible electrically-driven core-sampling assembly to alternately rotate in clockwise and counterclockwise directions, thereby causing the reactive torque and lateral forces resulting therefrom to alternately oppose each other so as to prevent the trajectory of the resulting corehole from drifting away from vertical as a result of one-sided reactive-torque-induced lateral force on the core bit, said reversible electrically-driven core-sampling assembly made to descend downward through the rock by the milling action of the rotating core bit, by the axial thrust provided by the suitable weight unit, or sinker bar, and by the hydraulic axial thrust provided by the downflowing drilling fluid upon said reversible electrically-driven core-sampling assembly, whereas the drum brake of said suitable wire-line conveyance system is released so as to allow its wire line to unspool in an unimpeded manner as said reversible electrically-driven core-sampling assembly progresses downward through the rock, increasing the voltage output by suitable transformer means prior to rectification to direct current, when necessitated by geologically-induced deviation problems, so as to cause a corresponding increase in the rotational speed of said reversible electrically-driven core-sampling assembly, thereby, increasing the influence of the milling action of the core bit on the low side of the corehole relative to the influence of the axial thrust upon the core bit, so as to cause the corehole trajectory to decrease its angle with the vertical if and when the corehole trajectory deviates from the vertical as a result of geological conditions encountered by the descending core bit, when geological conditions permit, decreasing the voltage output by suitable transformer means prior to rectification to direct current so as to cause a corresponding decrease in the rotational speed of said reversible electrically-driven core-sampling assembly, thereby, decreasing the influence of the milling action of the descending core bit relative to the influence of the axial thrust of the descending core bit, resulting in an increase in the influence of the axial thrust upon the descending core bit relative to the influence of the milling action upon the descending core bit, without the risk, or danger of applying any weight or axial thrust to said reversible electrically-driven core-sampling assembly from the suitable hole-enlarging means, or hole opener, or from any other heavy cylindrical or tubular components associated with the coring operation, and without the risk or danger of causing deviation of the corehole as a result of such excessive weight or axial thrust, said suitable hole-enlarging means, or hole opener, firmly implanted in the bottom of the hole, and prevented by its friction with the bottom of the hole from rotating as a result of the reactive torque imparted to it by said reversible electrically-driven core-sampling assembly, and said reversible elelectrically-driven core sampler prevented from rotating within said suitable hole-enlarging means, or hole-opener, by means of the longitudinal guide fins of the former which engage the longitudinal guide slots of the latter, circulating drilling fluid during coring operations by suitable pumping means at the surface so as to cause said drilling fluid to flow down through said suitable cylindrical conduit to said reversible electrically-driven core-sampling assembly, where said drilling fluid is directed through the annulus between said reversible electrically-driven core-sampling assembly and the central and axial bore through the suitable hole enlarging means, or hole opener, said drilling fluid then diverted into the interior of said reversible electrically-driven core-sampling assembly by means of the suitable pressure-actuated annular cup seal and the side ports, said drilling fluid then expelled through the water courses of the core bit, then flowing around the cutting blades of said suitable hole-enlarging means, or hole opener, and returning to the surface with its load of fine-grained core cuttings through the borehole annulus, said circulating drilling fluid continuously cooling the direct-current electric motor by continuously flowing around its centralizing heat-sink fins, retrieving said reversible electrically-driven core-sampling assembly by means of said suitable wire-line conveyance system at the completion of coring operations, enlarging each cored section of rock from top to bottom by means of said suitable hole-enlarging means, or hole opener, with excavation of rock taking place by either linear-motion or rotational excavation mode, circulating drilling fluid during hole-opening operations by suitable pumping means at the surface so as to cause said drilling fluid to flow down the borehole annulus to the cutting blades of said suitable hole-enlarging means, or hole opener, said drilling fluid, with its load of coarse-grained hole-opener cuttings, then flushed into the central and axial bore of said suitable hole enlarging means, or hole opener, and then returning to the surface through suitable cylindrical conduit, repeating the above-described procedure that defines the wire-line conveyed down-hole reversible electrically-driven high-speed thin-kerf core-sampling method until no more core samples are desired.

3. The invention of a hydraulically-conveyed assembly of down-hole reversible electrically-driven high-speed thin-kerf core-sampling apparatus comprising:

a hydraulic-conveyance system that employs suitable pumping means at the surface to energize, or pressurize drilling fluid within suitable cylindrical conduit beneath said reversible electrically-driven core-sampling assembly so as to propel said assembly upward through said suitable cylindrical conduit from the bottom of a hole excavated in rock to the ground surface, said hydraulic-conveyance system relying upon the force of gravity to subsequently return said core-sampling assembly to the bottom of said hole excavated in rock, an electrical transmission system that employs a suitable electrically-conductive wire circuit incorporated into the wall of suitable cylindrical conduit so as to transmit alternating electric current to the bottom of said hole excavated in rock, said alternating electric current transmitted to said reversible electrically-driven core-sampling assembly by means of an induction coil system composed of an insulated outer primary coil subsystem incorporated into the wall of the central and axial bore of a suitable hole-enlarging means, or hole opener, and an insulated inner secondary coil subsystem incorporated into the exterior surface of a weighted unit, or sinker bar, constituting the central core of the induction-coil system, said alternating electric current linked by induction means from the insulated outer primary coil subsystem to the insulated inner secondary coil subsystem, said alternating electric current rectified to direct current by means of a suitable down-hole rectifier affixed to said reversible electrically-driven core-sampling assembly, and the flow direction of said direct current alternately reversed at frequent intervals by means of a suitable down-hole automatic self-contained and self-powered switching device affixed to said core-sampling assembly, a weighted unit, or sinker bar, composed of a suitable ferfomagnetic metal, and possessing a high degree of magnetic permeability so as to function as said central core of said induction coil system, said weighted unit, or sinker bar, circumferentially enveloped on the exterior surface of its lower extremity by a plurality of insulated and helically-wound circular turns of electrically-conductive wire, said electrically-conductive wire connected by suitable electrical connecting means to said suitable downhole rectifier, said suitable downhole rectifier connected by suitable electrical connecting means to said suitable down-hole automatic self-contained and self-powered switching device, with a plurality of guide fins rigidly affixed to said weighted unit, or sinker bar, and arranged in a longitudinal manner on the exterior surface of said weighted unit, or sinker bar, a suitable reversible direct-current electric motor rigidly affixed, through its power-conditioning equipment, to said weighted unit, or sinker bar, said reversible direct-current electric motor rigidly attached to a plurality of centralizing heat-sink fins arranged in a longitudinal manner on the exterior surface of said suitable direct-current electric motor, with suitable electrical connecting means between said power conditioning equipment and said suitable reversible direct-current electric motor, and with a motor-case extension and a suitable splined rotational output shaft extending downward from the bottom of said suitable reversible direct-current electric motor, said suitable splined rotational output shaft enveloped at the bottom of said suitable reversible direct-current electric motor by suitable pressure-actuated sealing means so as to exclude outside fluid entry into said suitable direct-current electric motor, a suitable pressure-actuated annular cup seal enveloping said motor-case extension with its sealing lip facing up, below which is situated a lower suitable pressureactuate annular cup seal enveloping said motor-case extension with its sealing lip facing down, and a plurality of side ports through said motor-case extension, said side ports situated above the top, or up-facing suitable pressure-actuated annular cup seal, and a circumferential inward-facing shoulder rigidly affixed to the bottom of said motor-case extension, below which is situated a suitable bearing support, or circumferential thrust bearing, a suitable rotating outer cylindrical core barrel with suitable splined connecting means to said suitable splined rotational output shaft, containing a circumferential out-facing shoulder around its topmost perimeter, above which is situated suitable pressure-actuated sealing means, said suitable rotating outer cylindrical core barrel also containing a plurality of inclined fluid passageways at its top, and below which is situated, at the lowermost extremity of said suitable rotating outer cylindrical core barrel, a suitable core bit containing suitable water courses, a suitable nonrotating inner cylindrical core barrel containing at its topmost extremity a suitable pressure-actuated sealing means, below which is situated a central and axial fluid passageway, said suitable nonrotating inner cylindrical core barrel also containing near its top a circumferential out-facing shoulder, upon which is situated a suitable swivel bearing below which is situated a plurality of side ports and a suitable ball valve that is capable of providing sealing action on both a lower valve seat and an upper valve seat, depending upon whether the pressure gradient across said suitable ball valve is in a downward or an upward direction, respectively, whereas near the lower extremity of said suitable nonrotating inner cylindrical core barrel is situated circumferentially near its bottom interior a suitable core restraining device, or core catcher, a suitable hole-enlarging means, or hole opener, operating in either the linear-motion or rotational excavation mode, with said suitable hole-enlarging means, or hole opener, containing a central and axial bore of sufficient diameter to allow the passage of said reversible electrically-driven core-sampling assembly, with said central and axial bore containing in its wall a plurality of longitudinally-arranged guide slots, and an insulated outer primary coil subsystem, with the latter functioning as the primary coil of said induction coil system, said insulated outer primary coil subsystem lining the wall of said central and axial bore of said suitable hole enlarging means, or hole opener, by means of a plurality of insulated and helically-wound circular turns of electrically-conductive wire, said electrically-conductive wire connected by suitable electrical connecting means to said electrically-conductive wire circuit incorporated into the wall of said suitable cylindrical conduit.

4. The invention of a hydraulically-conveyed downhole reversible electrically-driven high-speed thin-kerf core-sampling method comprising the following procedure:

conveyance of the reversible electrically-driven core-sampling assembly described in claim 2 by the force of gravity through suitable cylindrical conduit from the ground surface to the bottom of a hole excavated in rock, said gravity-propelled conveyance prevented from exceeding a critical downward velocity by the expansion against the suitable cylindrical conduit's interior wall of the lower, or downward-facing pressure-actuated annular cup seal, described in claim 2, and by the sealing of the ball valve described in claim 2 at its upper sealing surface, thus, controlling the by-pass of the drilling fluid, respectively, around and within the descending reversible electrically-driven core-sampling assembly, providing a source of alternating-current electric power, and transmitting said alternating electric current through a suitable electrically-conductive wire circuit incorporated into the wall of suitable cylindrical conduit so as to transmit alternating electric current to the bottom of said hole excavated in rock, said alternating electric current transmitted to the reversible electrically-driven core sampling assembly described in claim 2 by means of the induction coil system described in claim 2, said alternating electric current rectified to direct current by suitable rectifying means affixed to said reversible electrically-driven core sampler, with the flow direction of said direct current reversed at frequent intervals by means of a suitable automatic self-contained and self-powered switching device, affixed, also, to said reversible electrically-driven core-sampling assembly, said frequent changes in the flow direction of direct current, correspondingly causing said reversible electrically-driven core-sampling assembly to alternately rotate in clockwise and counterclockwise directions, thereby, causing the reactive torque and lateral forces resulting therefrom to alternately oppose each other so as to prevent the trajectory of the resulting corehole from drifting away from vertical as a result of one-sided reactive-torque-induced lateral force on the core bit, said reversible electrically-driven core sampling assembly made to descend downward through the rock by the milling action of the rotating core bit, by the axial thrust provided by the suitable weighted unit or sinker bar, and by the hydraulic axial thrust provided by the down-flowing drilling fluid upon said reversible electrically-driven core-sampling assembly, increasing the voltage output of said source of alternating current electric power by suitable transformer means, when necessitated by geologically-induced deviation problems, so as to cause a corresponding increase in the rotational speed of said reversible electrically-driven core sampling assembly, thereby, increasing the influence of the milling action of the core bit on the low side of the corehole relative to the influence of the axial thrust upon the core bit so as to cause the corehole trajectory to decrease its angle with the vertical, if and when the corehole trajectory deviates from the vertical as a result of geological conditions encountered by the descending core bit, when geological conditions permit, decreasing the voltage output of said source of alternating current electric power by suitable transformer means so as to cause a corresponding decrease in the rotational speed of said reversible electrically-driven core-sampling assembly, thereby, decreasing the influence of the milling action of the descending core bit relative to the influence of the axial thrust of the descending core bit, resulting in an increase in the influence of the axial thrust upon the descending core bit, relative to the influence of the milling action upon the descending core bit, without the risk, or danger, of applying any weight or axial thrust to said reversible electrically-driven core-sampling assembly from the suitable hole-enlarging means, or hole opener, or from any other heavy cylindrical or tubular components associated with the coring operation, and without the risk or danger of causing deviation of the corehole as a result of such excessive weight or axial thrust, said suitable hole-enlarging means, or hole opener firmly implanted in the bottom of the hole, and prevented by its friction with the bottom of the hole from rotating as a result of the reactive torque imparted to it by said reversible electrically-driven core-sampling assembly, and said reversible electrically-driven core-sampling assembly prevented from rotating within said suitable hole-enlarging means, or hole opener, by means of the longitudinal quide fins of the former, which engage the longitudinal guide slots of the latter, circulating drilling fluid during coring operations by suitable pumping means at the surface so as to cause said drilling fluid to flow down through said suitable cylindrical conduit to said reversible electrically-driven core-sampling assembly, where said drilling fluid is directed through the annulus between said reversible electrically-driven core-sampling assembly and the central and axial bore through the suitable hole enlarging means, or hole opener, said drilling fluid then diverted into the interior of said reversible electrically-driven core-sampling assembly by means of the suitable pressure-actuated annular cup seal and the side ports, said drilling fluid then expelled through the water courses of the core bit, then flowing around the cutting blades of said suitable hole-enlarging means, or hole opener, and returning to the surface with its load of fine-grained core cuttings through the borehole annulus, said circulating drilling fluid continuously cooling the direct-current electric motor by continuously flowing around its centralizing heat-sink fins, retrieving said reversible electrically-driven core-sampling assembly by suitable pumping means at the surface, with the circulation of drilling fluid taking place down the borehole annulus and up through the suitable cylindrical conduit, said upward-flowing drilling fluid causing the lower, or down-facing pressure-actuated annular cup seal, affixed to the reversible electrically-driven core-sampling assembly described in claim 2, to expand against the interior wall of said suitable cylindrical conduit, whereas said upward flowing drilling fluid, also, causes the ball valve described in claim 2 to seal against its upper sealing surface so that drilling fluid pressure increases under said reversible electrically-driven core-sampling assembly and propels it upward to the surface through the suitable cylindrical conduit, enlarging each cored section of rock from top to bottom by means of said suitable hole-enlarging means, or hole opener, with excavation of rock taking place by either linear-motion or rotational excavation mode, circulating drilling fluid during hole-opening operations by suitable pumping means at the surface so as to cause said drilling fluid to flow down the borehole annulus to the cutting blades of said suitable hole-enlarging means, or hole opener, said drilling fluid with its load of coarse-grained hole-opener cuttings, then flushed into the central and axial bore of said suitable hole-enlarging means, or hole opener, and then returning to the surface through suitable cylindrical conduit, repeating the above-described procedure that defines the hydraulically-conveyed down-hole reversible electrically driven high-speed thin-kerf core-sampling method until no more core samples are desired.

* * * * *